US007094979B2

(12) United States Patent
Kurokawa et al.

(10) Patent No.: US 7,094,979 B2
(45) Date of Patent: Aug. 22, 2006

(54) SWITCHING DEVICE AND PORTABLE TERMINAL DEVICE

(75) Inventors: Susumu Kurokawa, Kanagawa (JP); Hiroyuki Hosogane, Saitama (JP)

(73) Assignee: Sony Ericsson Mobile Communications Japan, Inc., Tokyo (JP)

( * ) Notice: Subject to any disclaimer, the term of this patent is extended or adjusted under 35 U.S.C. 154(b) by 0 days.

(21) Appl. No.: 11/147,330

(22) Filed: Jun. 8, 2005

(65) Prior Publication Data

US 2005/0279619 A1 Dec. 22, 2005

(30) Foreign Application Priority Data

Jun. 18, 2004 (JP) ..... 2004-181451

(51) Int. Cl.
*H01H 25/04* (2006.01)

(52) U.S. Cl. ..... 200/5 R; 200/6 A

(58) Field of Classification Search ..... 200/5 A, 200/5 R, 6 A, 17 R, 18, 517, 4; 341/22; 345/156, 161, 168, 169
See application file for complete search history.

(56) References Cited

U.S. PATENT DOCUMENTS 3,483,337 A 12/1969 Johnstone et al.
3,691,324 A * 9/1972 Brantingson ..... 200/5 E
4,582,967 A * 4/1986 Brumit et al. ..... 200/5 A
4,786,766 A 11/1988 Kobayashi
5,086,313 A 2/1992 Misawa
5,164,554 A * 11/1992 Ikunami ..... 200/5 E
5,525,770 A 6/1996 Matsumiya et al.
RE36,349 E * 10/1999 Matsumiya et al. ..... 200/6 A
6,246,019 B1 * 6/2001 Nakamura et al. ..... 200/6 A
6,657,147 B1 * 12/2003 Tsutsui et al. ..... 200/517
6,670,563 B1 * 12/2003 Jeon ..... 200/11 R
6,961,052 B1 * 11/2005 Vaziri ..... 345/184

* cited by examiner

*Primary Examiner*—Michael A. Friedhofer
(74) *Attorney, Agent, or Firm*—Oblon, Spivak, McClelland, Maier & Neustadt, P.C.

(57) ABSTRACT

A switching device is provided in which a substrate on which switch components are arranged, a resilient sheet arranged on this substrate and a button arranged on the resilient sheet are stored in a predetermined case such that the surface of the button is exposed, and the switch components are operated by being pressed by the button; on the periphery of the button are provided a plurality of columnar projections whose ends are approximately spherical (or tapered depressions) in the direction approximately at right angles to an upper surface pressing the button, and on the surface of the case in contact with the button are provided a plurality of tapered depressions (or columnar projections whose ends are approximately spherical) which engage with the columnar projections (or tapered depressions) of the button. Accordingly, the switching device which can be easily assembled is obtained, including an operational button which returns to a predetermined position in a hole with the release after pushed down.

18 Claims, 16 Drawing Sheets

SWITCHING DEVICE AND PORTABLE TERMINAL DEVICE

CROSS REFERENCES TO RELATED APPLICATIONS

The present invention contains subject matter related to Japanese Patent Application JP 2004-166243 filed in the Japanese Patent Office on Jun. 3, 2004, the entire contents of which being incorporated herein by reference.

BACKGROUND OF THE INVENTION

1. Field of the Invention

The present invention relates to a push-button switching device suitably applied to electronic equipment such as a mobile phone unit, and relates to a portable terminal device including the switching device.

2. Description of the Related Art

In the past, in electronic equipment such as a mobile phone unit, a switching device used for moving a cursor and inputting characters such as a dial number has a structure in which a button that is a component made of resin and is pressed by a user's finger and an insulating rubber component provided with a protrusion functioning as a pusher for operating the switching device on a wiring substrate are stuck and fixed, and upon pushing the upper surface of the button that is a resin component exposed on the upper surface of a casing of the mobile phone unit, the contact of a switch is made to close by pressing a protrusion (pusher) of a rubber component provided thereunder.

FIGS. 1 to 3 schematically show a switch structure of buttons arranged and used for character-inputting, dial numbers and the like.

FIG. 1 and FIGS. 2A to 2C show an example of a structure of a switching device in an operational button portion in a mobile phone unit, and FIG. 1 shows a button operational portion in an assembled state. FIGS. 2A to 2C are figures showing in an exploded manner the button operational portion shown in FIG. 1, in which FIG. 2A shows an upper case provided with buttons; FIG. 2B shows buttons arranged and fixed onto a resilient sheet; and FIG. 2C shows a wiring substrate having contacts installed in a lower case. Further, FIGS. 3A and 3B are figures explaining the operation of the switching device shown in FIG. 1, in which FIG. 3A is a schematic sectional diagram before pushing a button; and FIG. 3B is a schematic sectional diagram after pushing the button.

In FIG. 1, a plurality of push-buttons 50 are disposed as an operational button portion in a mobile phone unit; a plurality of switching devices are arranged in a casing including an upper case 51 and a lower case 52; and the upper surfaces 50-1 (refer to FIG. 2B) of the push-buttons 50 functioning as an operational portion for operating the switching devices are exposed from the upper case 51.

As shown in FIG. 2A, the upper case 51 is formed by molding plastic or the like and is provided with approximately rectangular holes 51*a* through which the upper surfaces 50-1 of the plurality of push-buttons 50 can be exposed.

The button 50 is, for example, made of plastic resin whose upper part is transparent, and has the shape of approximately a rectangular parallelepiped, the upper surface 50-1 of which is similar to and smaller than the hole 51*a* in the upper case 51 as shown in FIG. 2B; and stepped differences are integrally provided on two opposing side surfaces on the side of a bottom surface 50-2 of this approximately rectangular parallelepiped such that the button 50 may not fall off the hole 51*a*. Further, a plurality of the buttons 50 are arranged on a resilient sheet 53 that is an insulating rubber component. In addition, characters such as the kana and alphabet and numerals are displayed on the surfaces of these buttons 50 by means of printing, stamping, and the like.

This resilient sheet 53 is made by molding insulating, resilient silicon rubber or the like and is a pliable thin sheet, the back surface 53-2 of which is provided with pushers 53-3, . . . , and as shown in FIG. 2B, the buttons 50 are arranged on the front surface 53-1 of the resilient sheet 53, being fixed with adhesive 53*a*.

On this occasion, the pushers 53-3 which approximately correspond to the centers of the bottom surfaces 50-2 of the buttons 50 are provided on the back surface 53-2 of the resilient sheet 53. Further, on the resilient sheet 53, the buttons 50 are arranged and fixed with an intended space, so that when fitted into the upper case 51 shown in FIG. 2A, the upper parts of the buttons 50 and the sidewalls of the holes 51*a* will not interfere with each other.

Further, on the back surface 53-2 side of the resilient sheet 53 is placed a wiring substrate 54 fixed to the side of the lower case 52, as shown in FIG. 2C. This wiring substrate 54 is made of a thin printed-wiring board, flexible wiring board and the like, and on the upper surface 54-1 are provided contacts 54*a* in such positions as correspond to the pushers 53-3 on the back surface 53-2 of the resilient sheet 53.

As shown in the sectional view of FIG. 3A, the contacts 54*a* are, for example, ones in which a plurality of dome components 55 formed of metal thin plates are provided on the wiring substrate 54; annular conductive pads 54*c* are formed on the upper surface 54-1 of the wiring substrate 54 and circular pads 54*d* formed in the centers of the conductive pads 54*c*, and the circular peripheries of the dome components 55 are disposed to virtually touch the whole circumference of the annular conductive pads 54*c*. Further, virtually the whole of the upper surface 54-1 of the substrate 54 is covered with an insulating film not shown in the figure so as to fix the dome components 55.

As regards the assembly of a button operational portion, with the resilient sheet 53 to which the push-buttons 50 are stuck as shown in FIG. 2B, having been installed in the lower case 52 to which the wiring substrate 54 is fixed as shown in FIG. 2C, the upper case 51 shown in FIG. 2A is laid from above so that the buttons 50 will be exposed from the holes 51*a* of the case 51; and these upper and lower cases 51 and 52 are fixed with adhesive, screws, and the like.

On this occasion, as shown in FIG. 3A, the buttons 50, the resilient sheet 53 and the wiring substrate 54 having the dome components 55, installed between the upper case 51 and the lower case 52, are assembled without vertical rattling.

In addition, in order for the resilient sheet 53 and the wiring substrate 54 not to be misaligned with respect to the upper case 51 and the lower case 52 in the assembly or the operation of the buttons 50, the resilient sheet 53, the wiring substrate 54, the upper case 51 and the lower case 52 are provided with a projection 53-4, a hole 54-2, a depression 51-2 and a protrusion 52-1 respectively, and the projection 53-4 and the hole 54-2 are made to engage with the depression 51-2 and the protrusion 52-1 respectively as shown, for example, in FIG. 3A.

Regarding the operation of a switching device constructed in this manner, the state shown in FIG. 3A in which the push-button 50 has not been pushed down changes into the state shown in FIG. 3B by pushing down the button 50, the resilient sheet 53 changes the shape thereof and bends in a downward direction when pushed by the push-button 50, and the pusher 53-3 pushes down the top of the dome component 55 to be deformed. Further by pressing the inside surface of the top of the dome component 55 against the circular pad 54*d* of the wiring substrate 54, the annular conductive pad 54*c* and the circular pad 54*d* are electrically connected to close the contact, and a sensation of clicking at the time of deforming the dome component 55 is felt by a finger used for the operation.

Further, when the force pushing down the push-button 50 is released, the state of FIG. 3B returns to the original state shown in FIG. 3A with the restoring force of the dome component 55 and the resilient sheet 53.

In addition, as this kind of a switching device in a mobile phone unit, an example is disclosed in Patent Literature 1.

[Patent Literature 1] Published Japanese Patent Application No. 6-309992 (page. 2, FIG. 4)

SUMMARY OF THE INVENTION

However, regarding the switching devices shown in the example of FIGS. 1 to 3, since it is necessary for the push-buttons 50 fixed to the resilient sheet 53 to be installed in such a manner as not to lean against or incline toward the holes 51*a* of the upper case 51, it is difficult to purchase the buttons 50 and the resilient sheet 53 separately and then fit into each other when the push-button portion of a mobile phone unit is assembled; therefore, the push-buttons 50 already fixed in intended positions on the resilient sheet 53 have often been purchased.

In other words, in order for the assembly to be executed with the buttons 50 fixed to the pliable resilient sheet 53, it is necessary to take behavior, effects on the resilient sheet and so forth caused by hardening conditions of the adhesive into account and to secure positional accuracy after the hardening thereof, so that a great deal of effort is required for the assembly with adhesive, which causes a problem of high unit prices of components.

Further, switching devices of this kind are switches which independently function as simple push-buttons in the past, and switches capable of executing a more advanced input operation using a simple structure have been in great demand.

The present invention addresses the above-identified, and other problems associated with conventional methods and apparatuses and provides a switch of this kind in which an advanced input operation can be executed using a simple structure.

A switching device or a mobile phone unit having the switching device according to an embodiment of the present invention, includes a button which operates a switch component in accordance with pushing operation, a case which stores the button in a state in which the pushed-down surface of the button is at least exposed, a first position-deciding portion provided on the periphery of the button, and a second position-deciding portion provided on the surface of the case in contact with the button and on the position corresponding to the first position-deciding portion; in which the position of the button is fixed to the case by the first and second position-deciding portions engaging with each other.

With the above structure, when the pushed-down surface of the button, exposed from the casing is pushed down, the first position-deciding portion on the side of this button descends toward the second position-deciding portion on the case side, which engages with this first position-deciding portion, thereby operating the switch component.

Further, the above-mentioned switching device according to an embodiment of the present invention further includes a substrate on which switch components are arranged, a resilient sheet arranged on this substrate, and a button arranged on this resilient sheet; in which on the periphery of the button are provided a plurality of projections or tapered depressions in the direction approximately at right angles to the pushed-down surface thereof, and on the surface of the case in contact with the button are provided a plurality of tapered depressions or projections which engage with the projections or tapered depressions of the button respectively.

With this structure, the position of the button is fixed by the projections or tapered depressions on the case side engaging with the projections or tapered depressions on the button side respectively, thereby making it unnecessary for the button to be stuck to the resilient sheet. Further even if there is a rattle caused by a space between the tapered depressions and projections which are arranged on the case and on the button and which engage with each other after the button has been pushed, it is possible for the button to return to the original position thereof, where the button is centered without the rattle against the hole of the case from which the pushed-down surface of the button is exposed, because when force with which to push down the button is released, the projections on one side follow the tapers of the depressions on the other by means of restoring force generated by the resilience of the resilient sheet and the like; therefore, the button is allowed to be pushed and handled in an inclined state.

According to an embodiment of the present invention, since the first position-deciding portion provided on the button engages with the second position-deciding portion provided on the case, a position-adjusting function which makes the button to be in a predetermined position with respect to the case can be given.

In the above embodiment, a multifunctional switching device in which four switch components can be operated by one button can be constructed by providing a disk-shaped button, providing four columnar projections whose ends are approximately spherical and/or four tapered depressions with a pitch of approximately 90° with respect to the center of the button while providing four projections and/or four depressions in the vicinity of the hole of the case, and arranging by a pitch of approximately 90° the four switch components each shifted approximately 45° away from the projections or depressions with respect to the center of the button.

Further, according to an embodiment of the present invention, a position-adjusting function is provided, a button is stored in a case without rattling by means of a resilient sheet, and when the force with which the button is pushed down is released, the button can return to the original position thereof, where the button does not rattle against the case by means of the resilient sheet, so that it is not necessary for the button to be fixed in a predetermined position on the resilient sheet, and it is therefore not necessary for the button and the resilient sheet to be stuck together, which can lower the production cost.

In the above embodiment, a multifunctional switching device in which four switch components can be operated by one button and when the operational force with which to push down the button is released, the button automatically returns to the original state before pushed down can be constructed by providing a disk-shaped button, providing four columnar projections whose ends are approximately spherical and/or four tapered depressions with a pitch of approximately 90° with respect to the center of the button while providing four projections and/or four depressions in the vicinity of the hole of the case, and arranging by a pitch of approximately 90° the four switch components each shifted approximately 45° away from the projections or depressions with respect to the center of the button.

BRIEF DESCRIPTION OF THE DRAWINGS

FIGS. 2A to 2C are perspective views showing in an exploded manner members constituting the switching device of the example in FIG. 1, in which FIG. 2A shows an upper case; FIG. 2B shows buttons fixed to a resilient sheet; and FIG. 2C shows a wiring substrate having contacts which is fixed to a lower case;

FIGS. 3A and 3B are cross-sectional views showing an example of a structure of a switching device in a mobile phone unit of related art, wherein FIG. 3A shows a state before a pushing-down operation and FIG. 3B shows a state after the pushing-down operation;

FIGS. 16A and 16B are sectional views showing operational states according to an embodiment of the present invention, in which FIG. 16A shows a state before a pushing-down operation and FIG. 16B shows a state after the pushing-down operation.

DESCRIPTION OF THE PREFERRED EMBODIMENTS

Hereinafter, an embodiment of the present invention will be explained referring to FIGS. 4 to 17.

Figure 1:
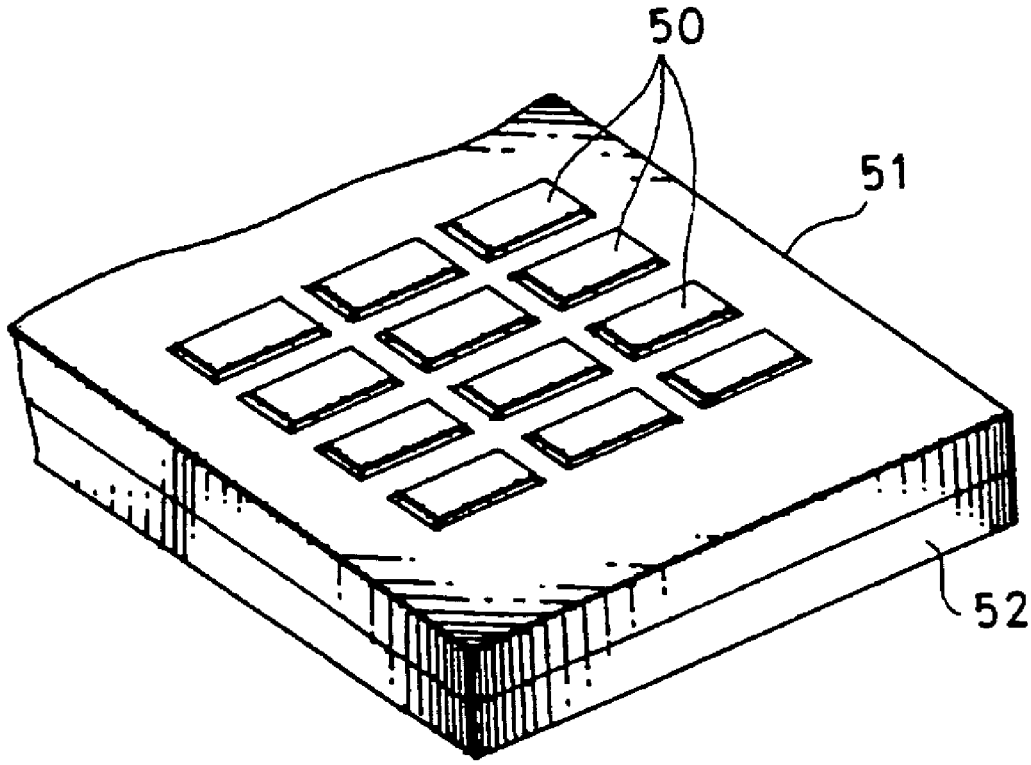
FIG. 1 (RELATED ART)
FIG. 1 is a perspective view showing an example of a structure of a button operational portion of a switching device in a mobile phone unit of related art.
Figure 2A:
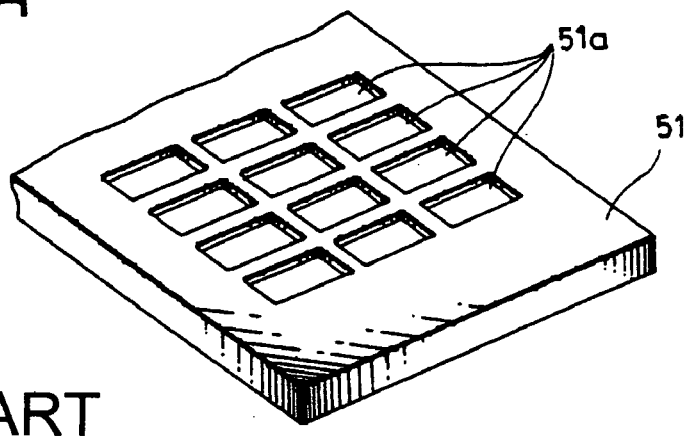
PRIOR ART FIG. 2A
Figure 2B:
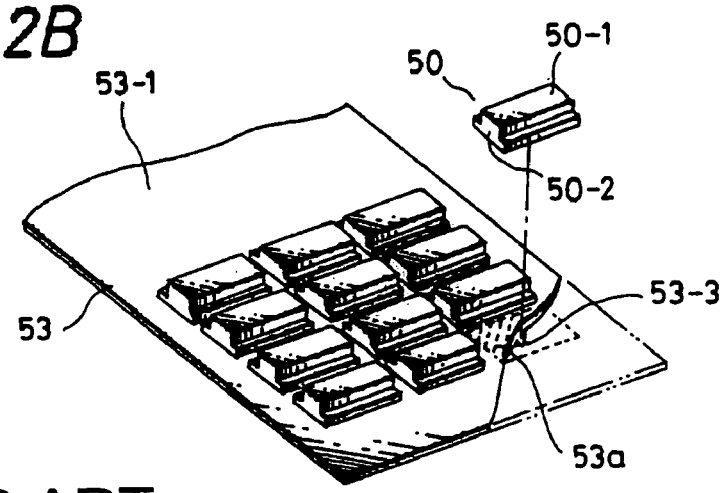
PRIOR ART FIG. 2B
Figure 2C:
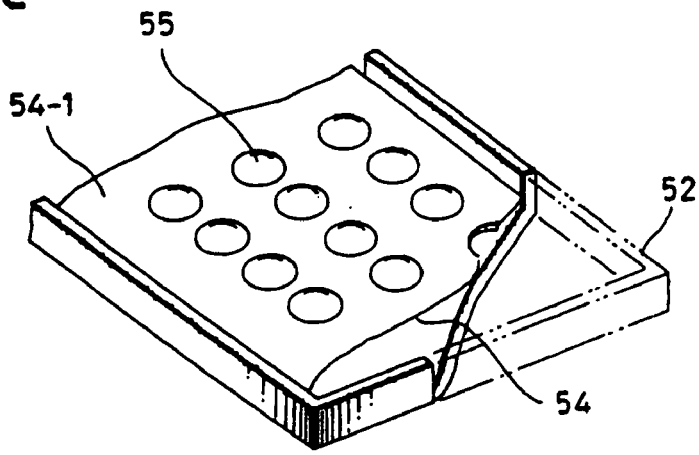
PRIOR ART FIG. 2C
Figure 3A:
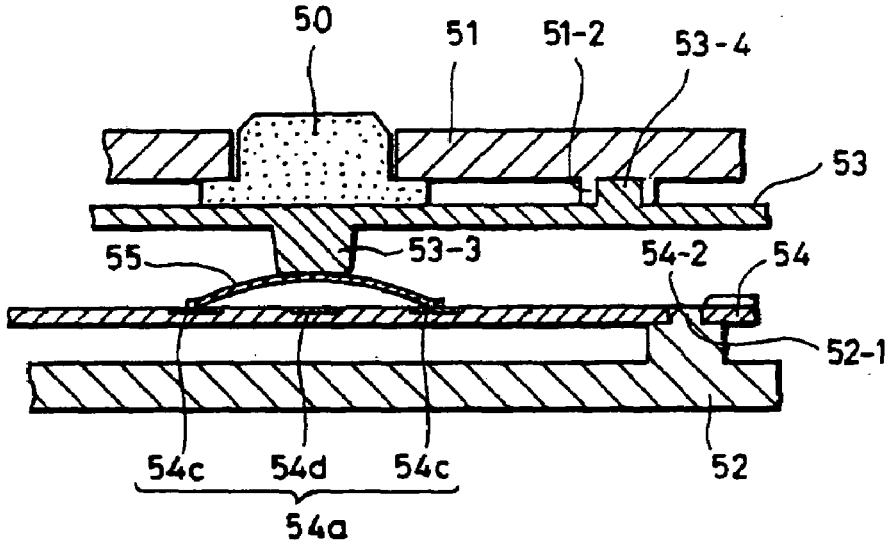
PRIOR ART FIG. 3A
Figure 3B:
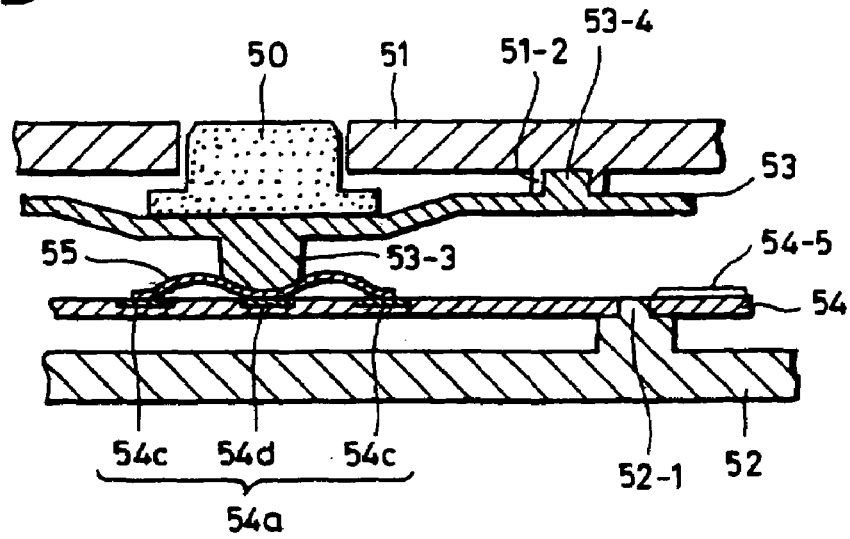
PRIOR ART FIG. 3B
Figure 4:
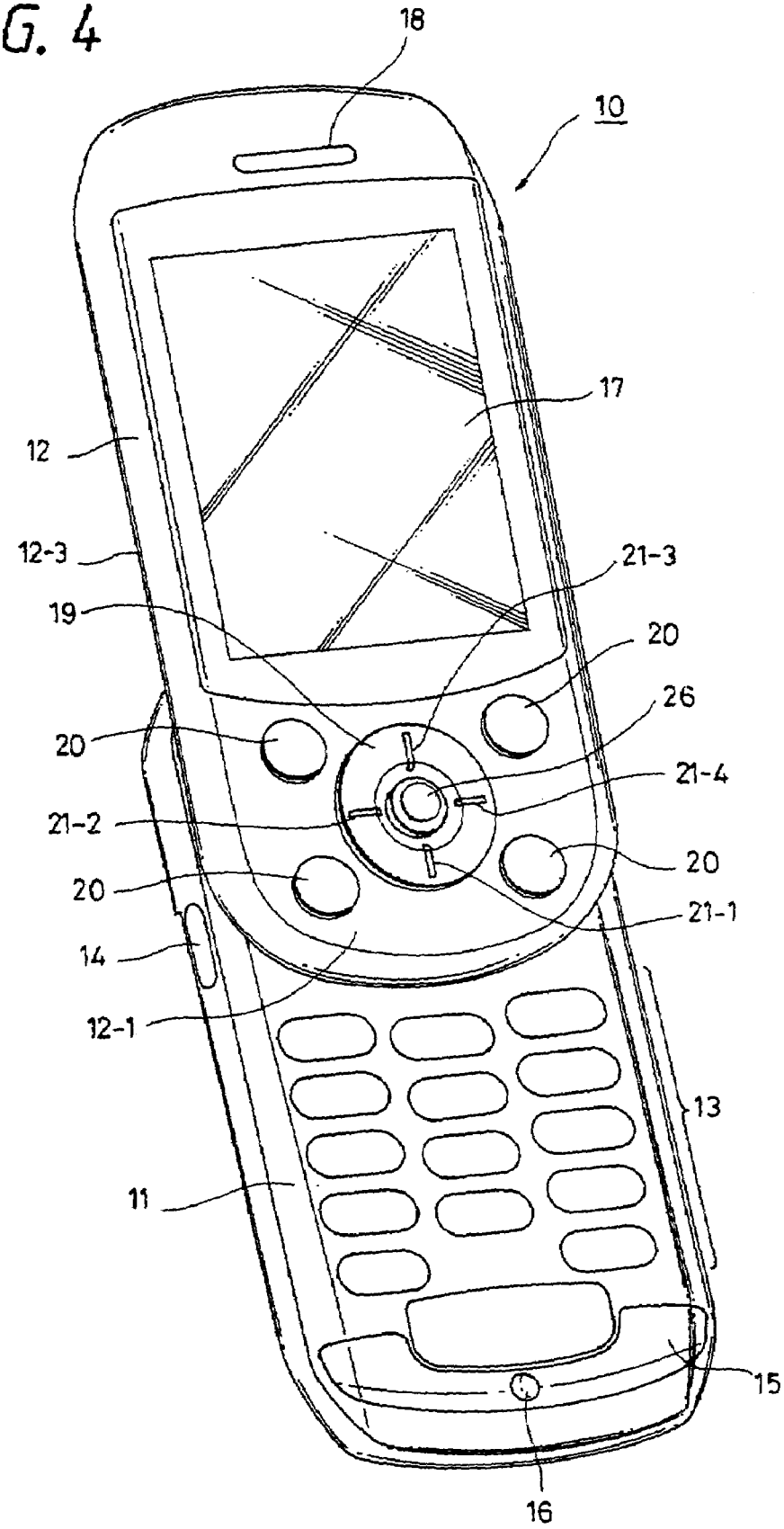
FIG. 4 is a perspective view showing an example of the outside appearance of a mobile phone unit according to an embodiment of the present invention.
Figure 5:
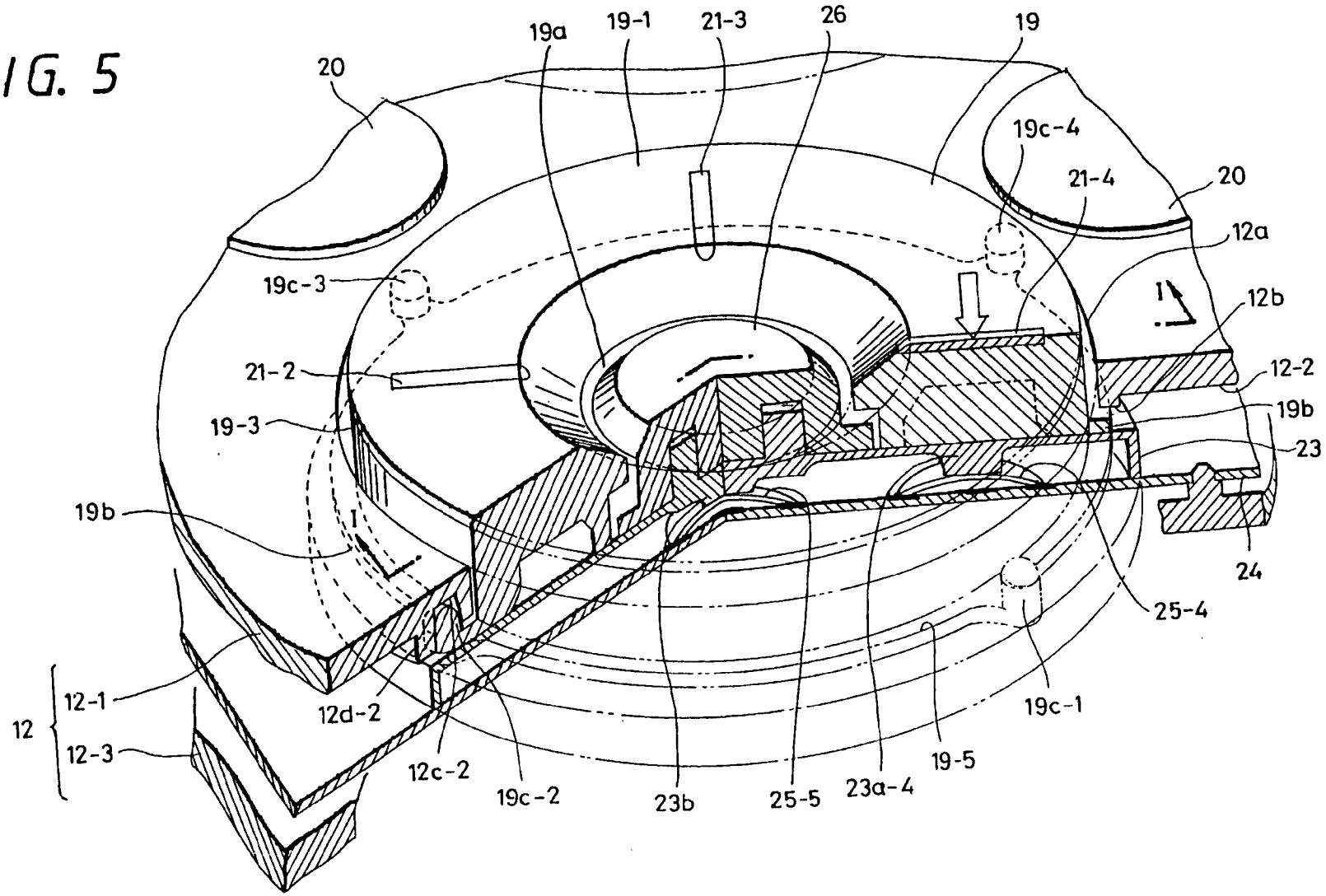
FIG. 5 is a partly sectional perspective view showing the relevant part of a structure according to an embodiment of the present invention in an enlarged and partly sectional manner.
Figure 6:
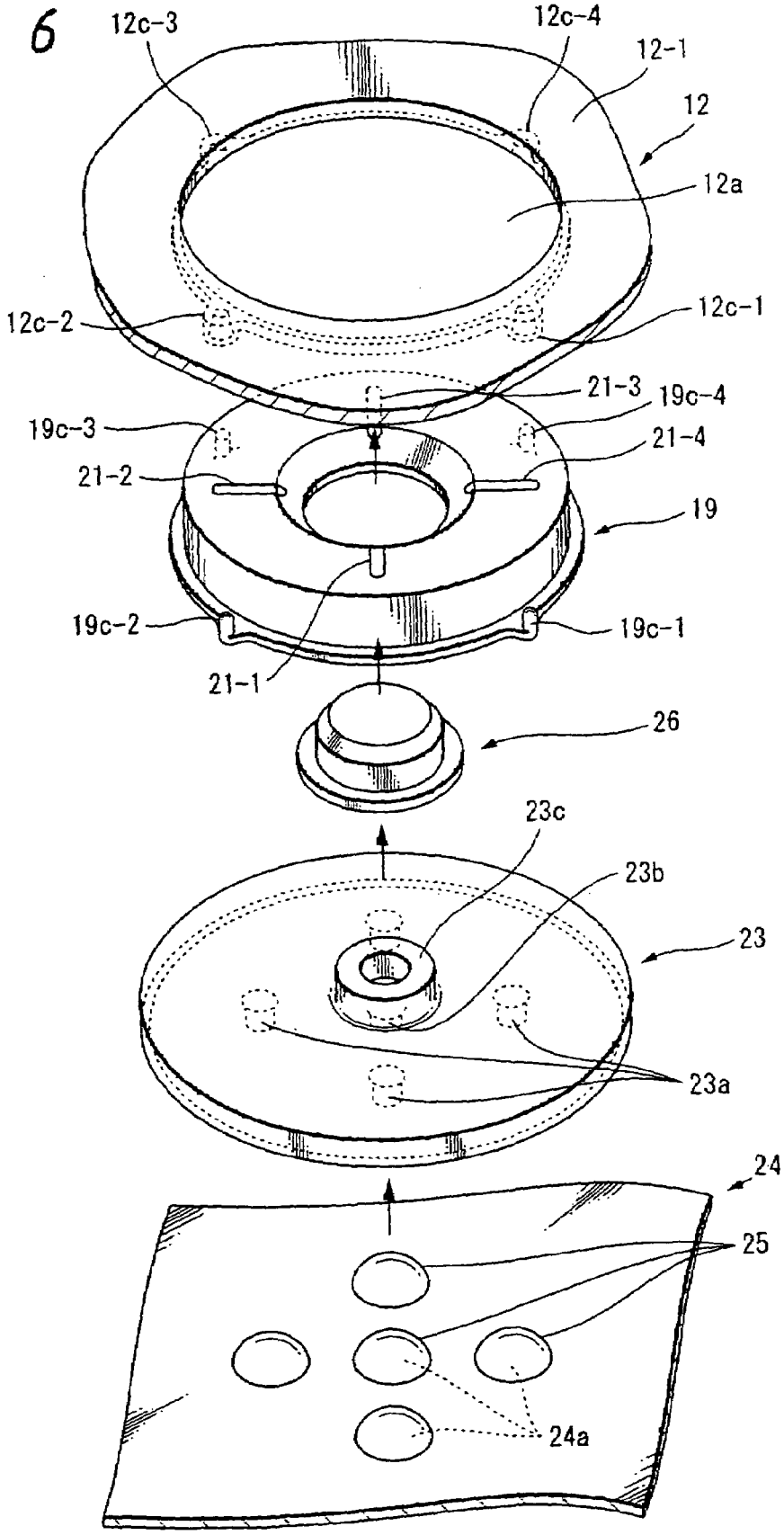
FIG. 6 is an exploded perspective view of the relevant part of a structure according to an embodiment of the present invention.
Figure 7:
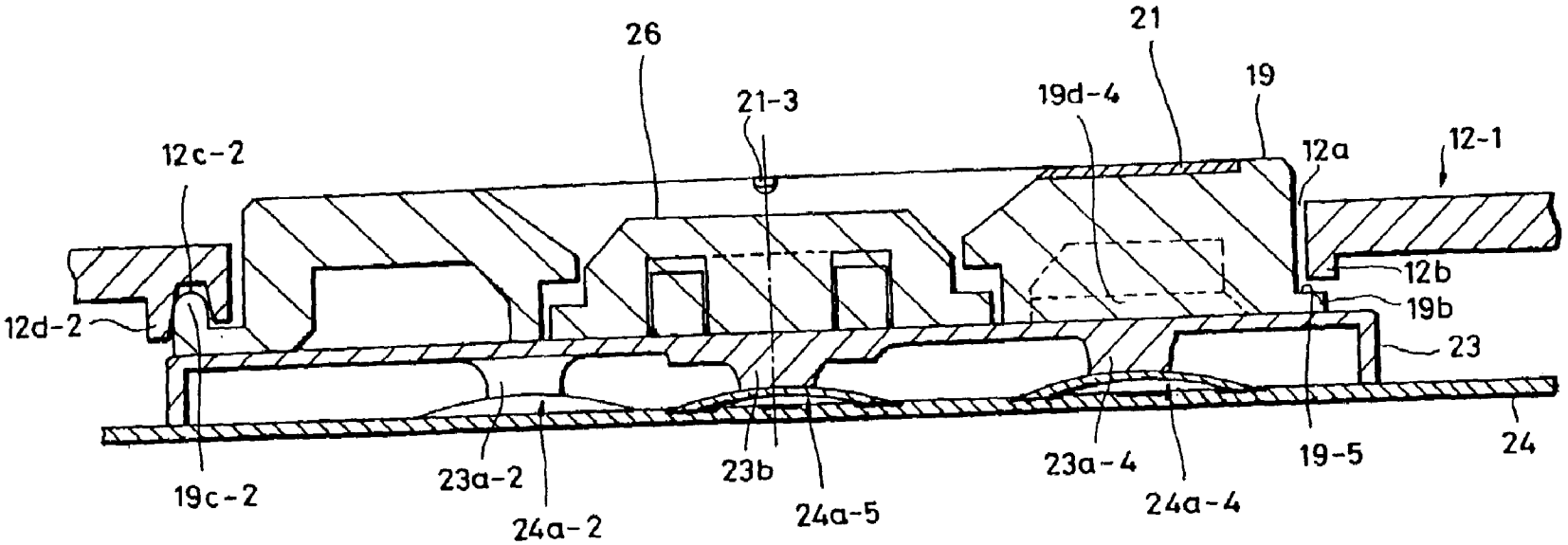
FIG. 7 is a sectional view corresponding to the I—I line in FIG. 5.
Figure 8:
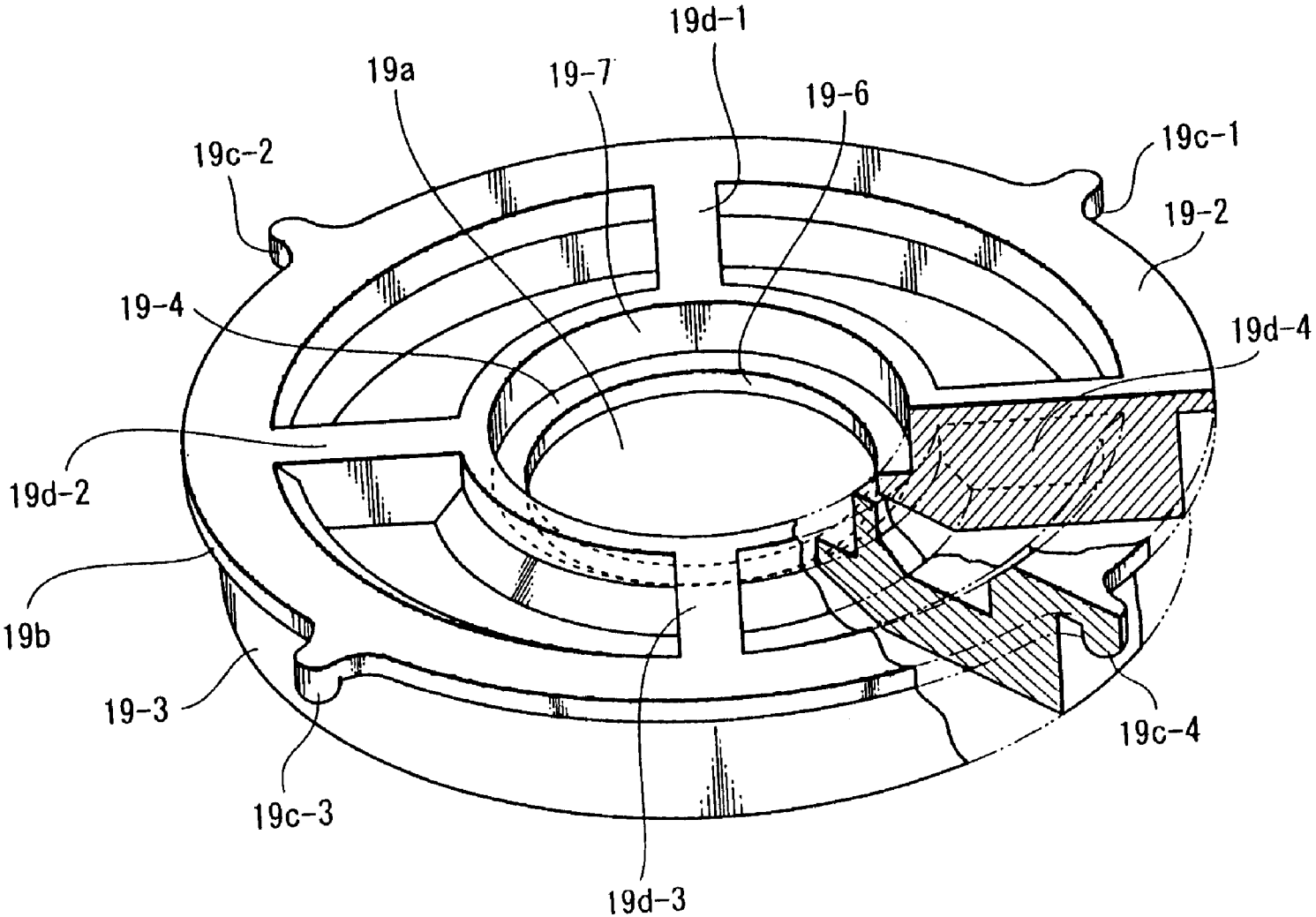
FIG. 8 is a perspective view of a direction-inputting button shown from the back surface thereof according to an embodiment of the present invention.
Figure 9:
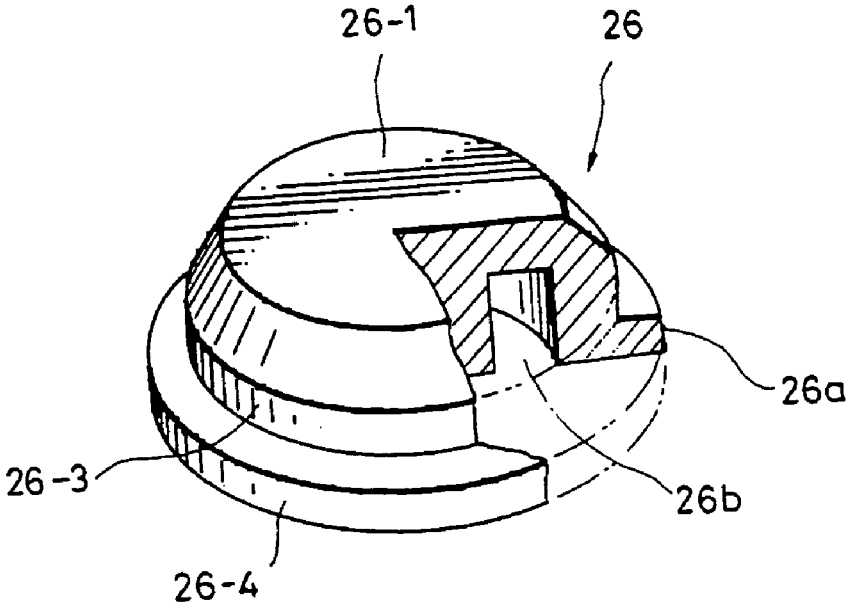
FIG. 9 is a perspective view of a center button shown from above according to an embodiment of the present invention.
Figure 10:
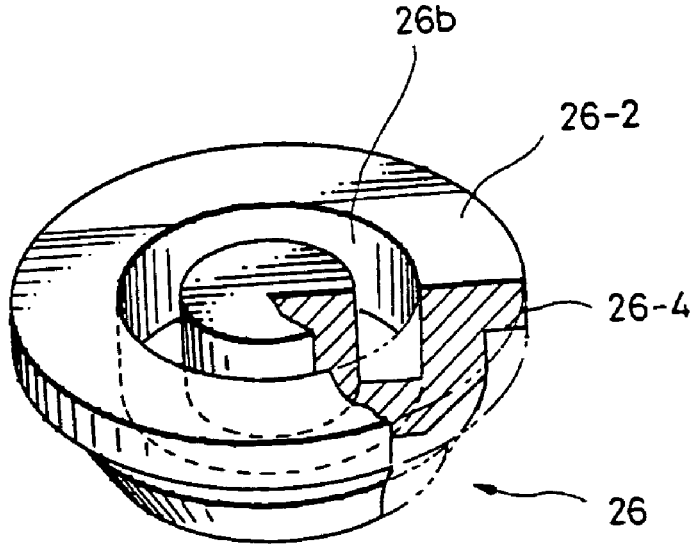
FIG. 10 is a perspective view of a center button, the back surface of which is shown from the bottom surface, according to an embodiment of the present invention.
Figure 11:
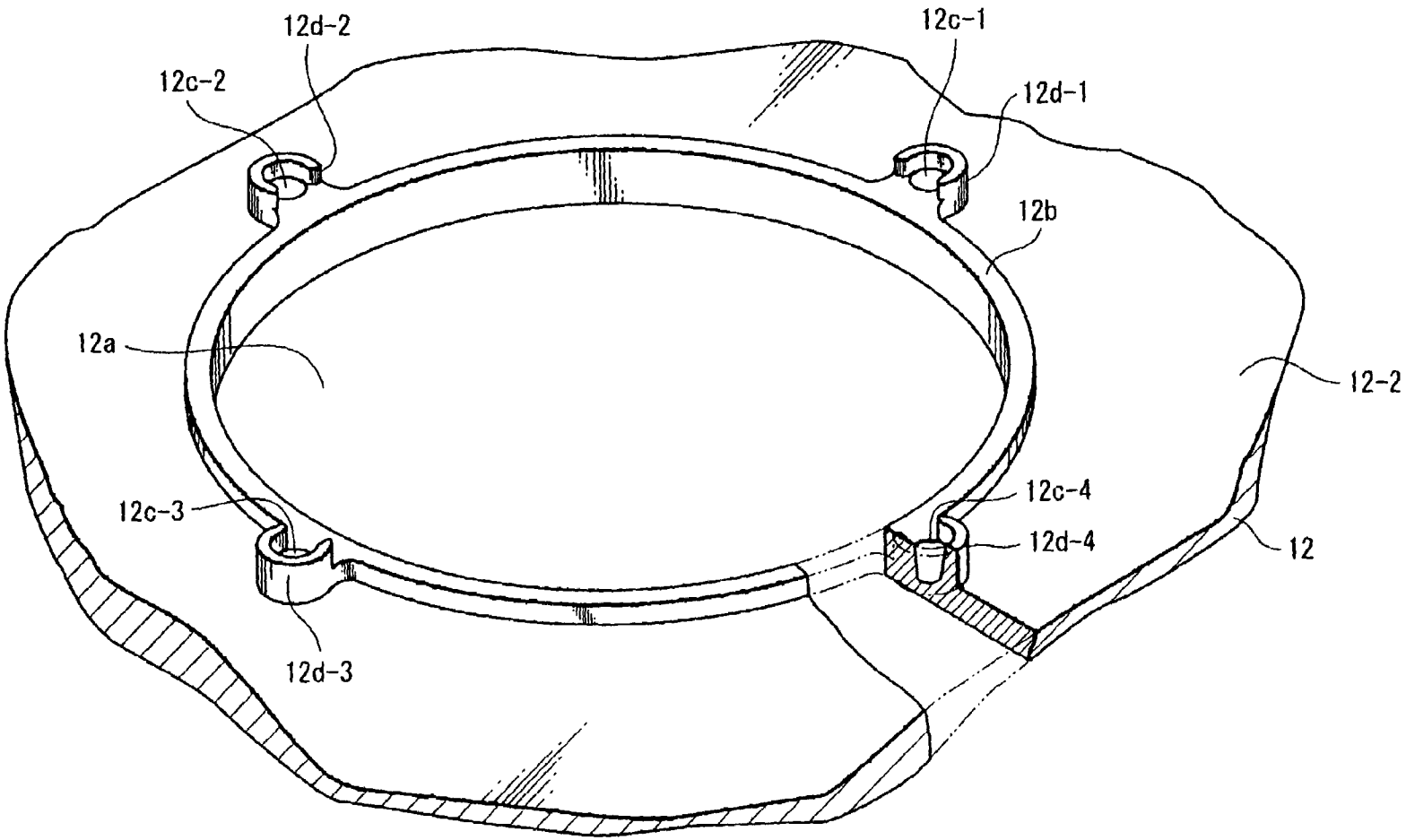
FIG. 11 is a perspective view showing a hole portion in the back surface of a case through which the direction-inputting button according to an embodiment of the present invention is installed.
Figure 12:
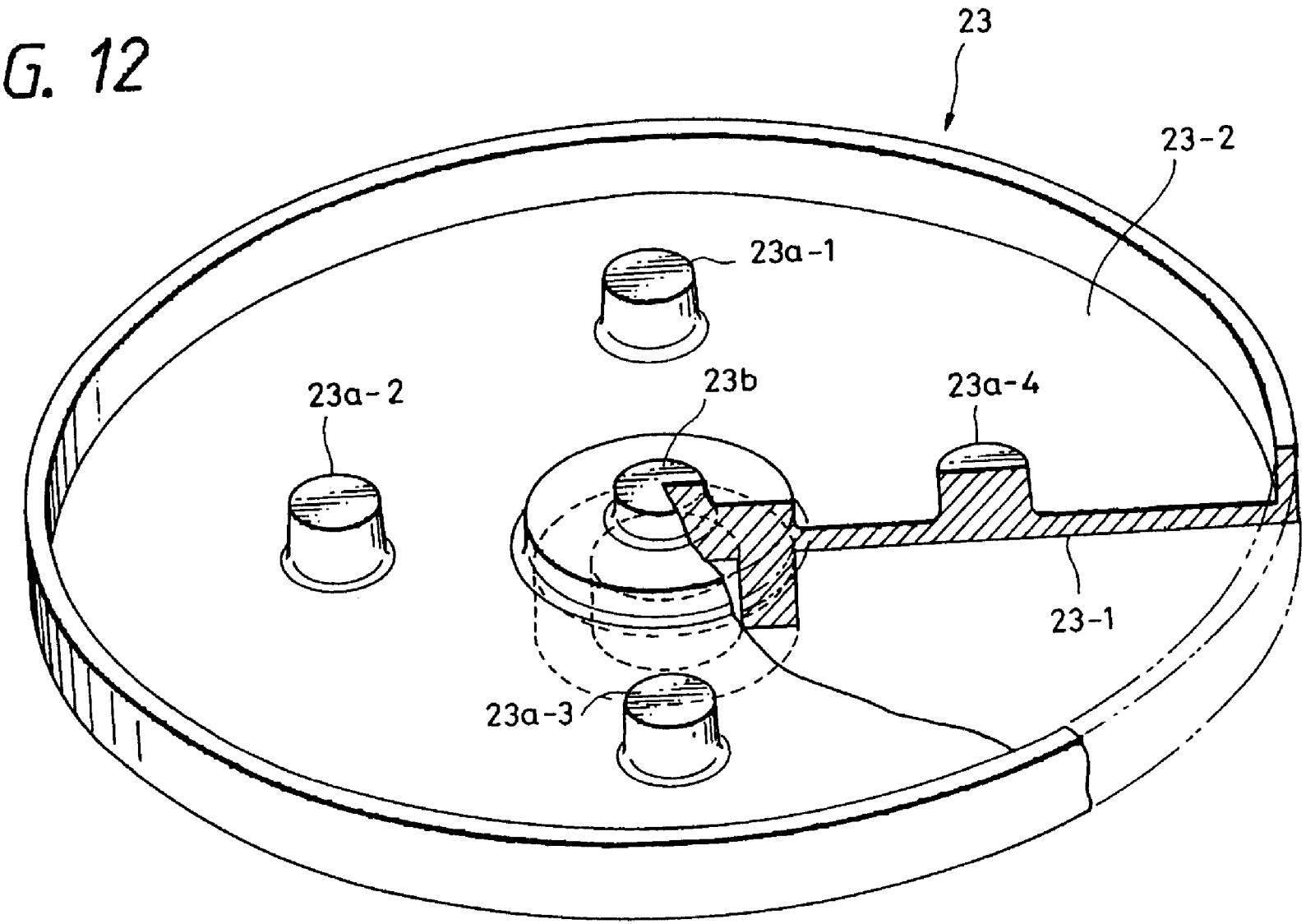
FIG. 12 is a perspective view of a resilient sheet according to an embodiment of the present invention.
Figure 13:
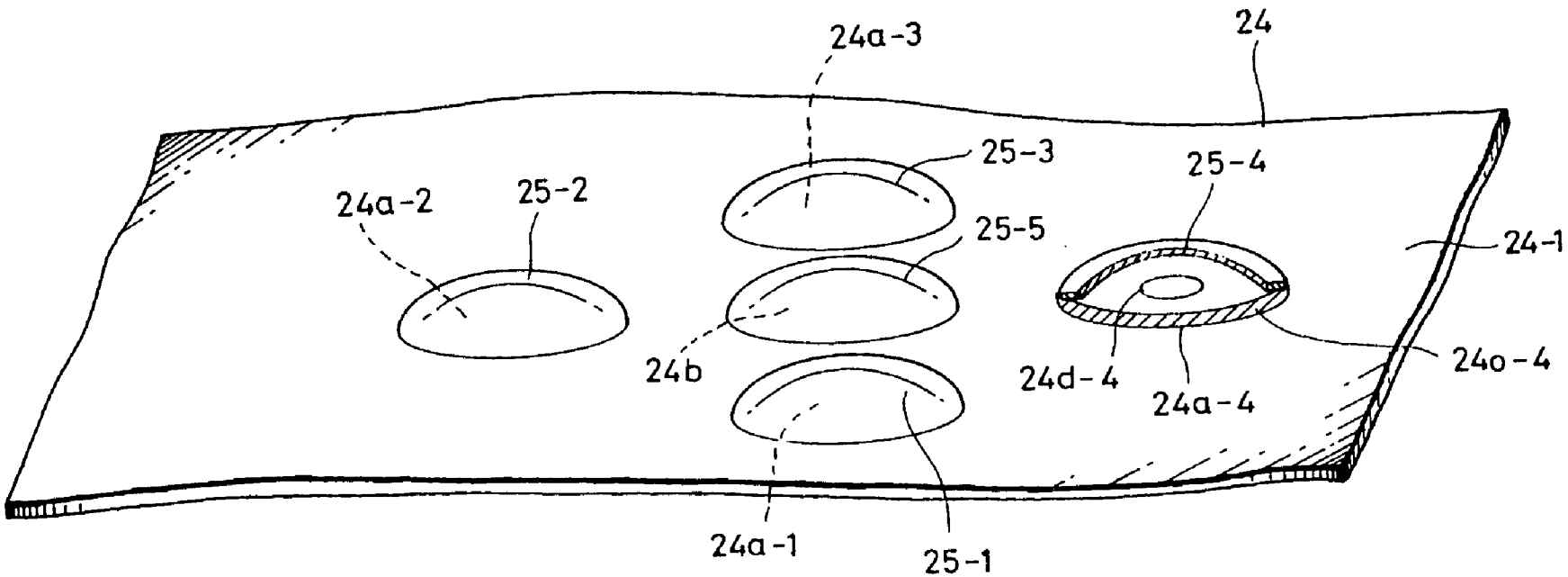
FIG. 13 is a perspective view showing a substrate according to an embodiment of the present invention.
Figure 14:
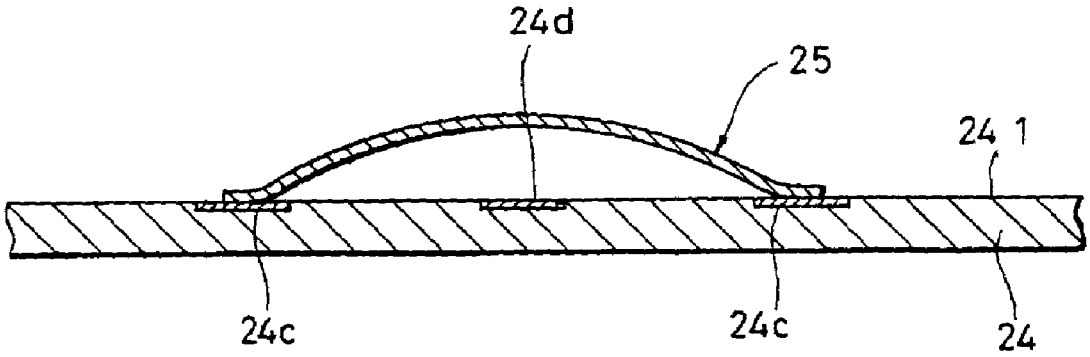
FIG. 14 is a schematic sectional view for explaining a structure of a contact according to an embodiment of the present invention.
Figure 15:
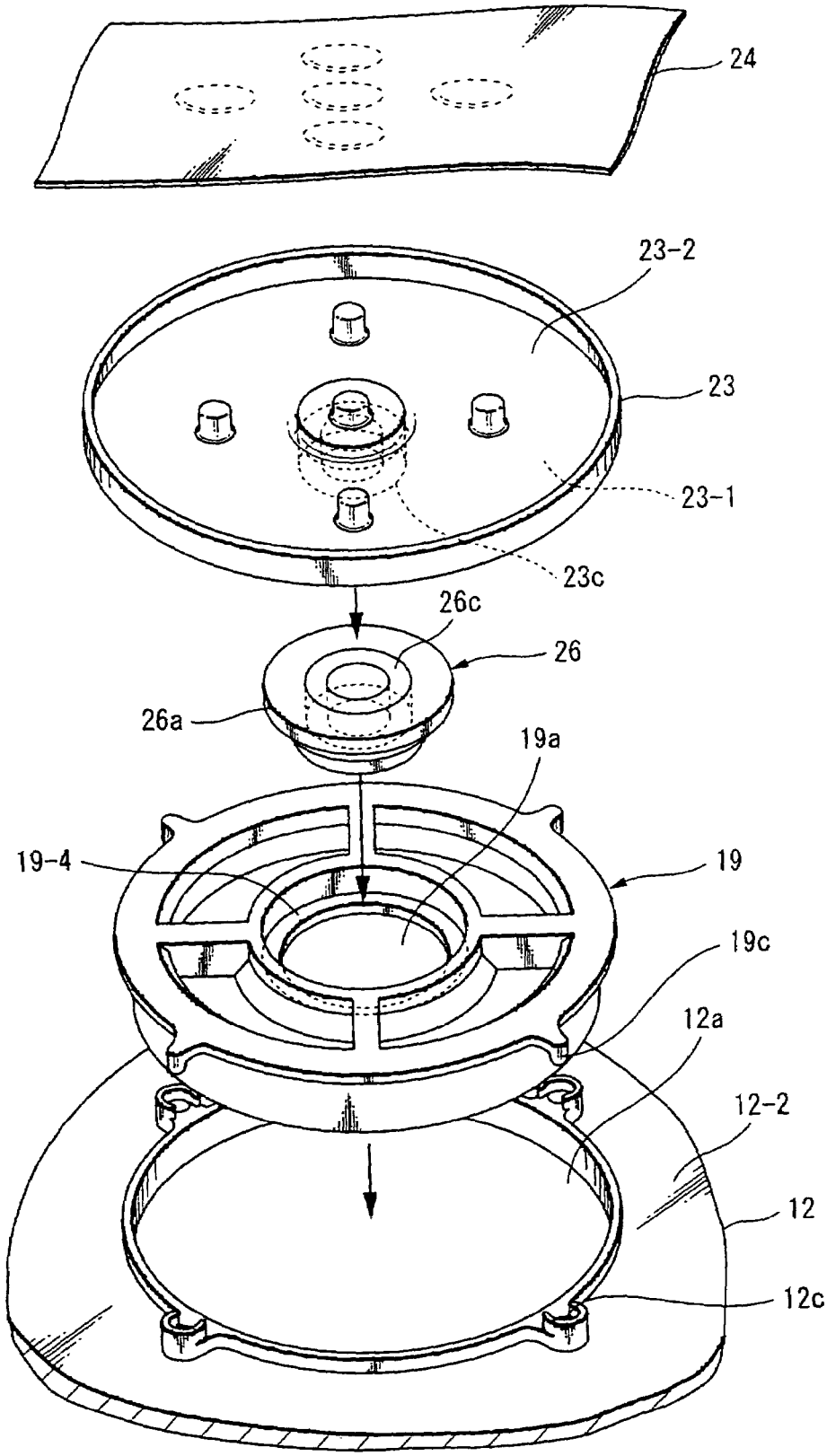
FIG. 15 is an exploded perspective view for explaining the assembling order according to an embodiment of the present invention.
Figure 16A:
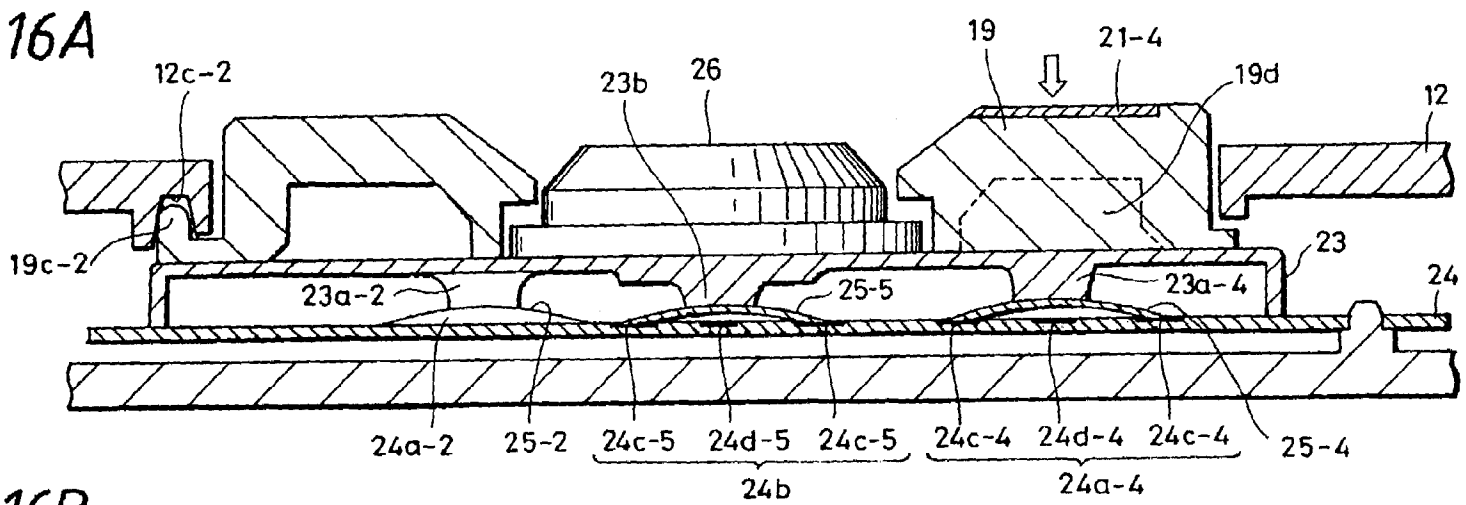
Figure 16B:
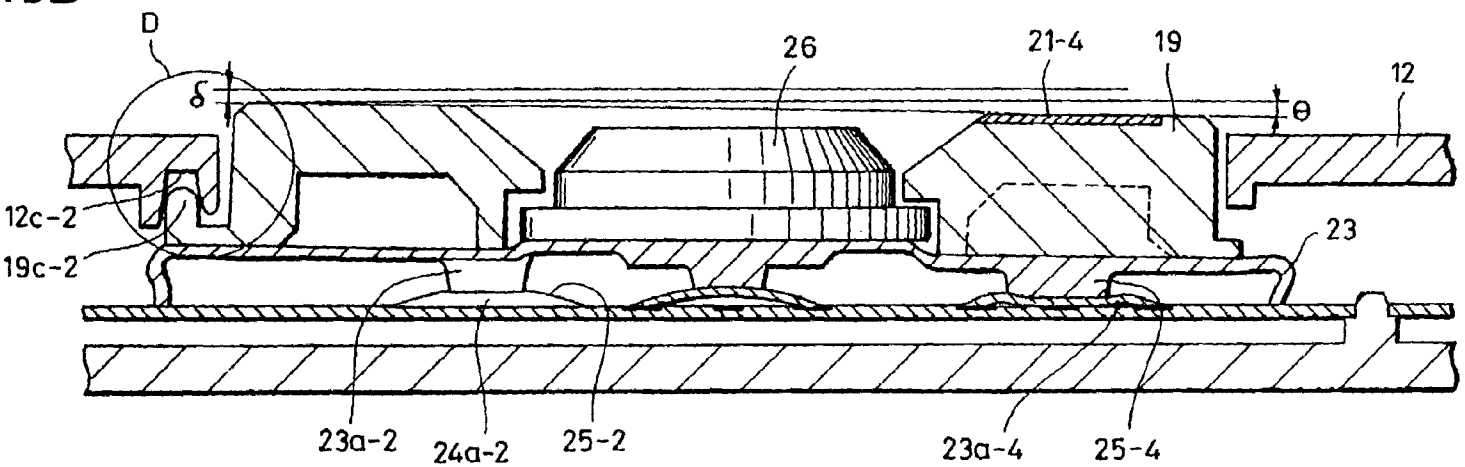
Figure 17:
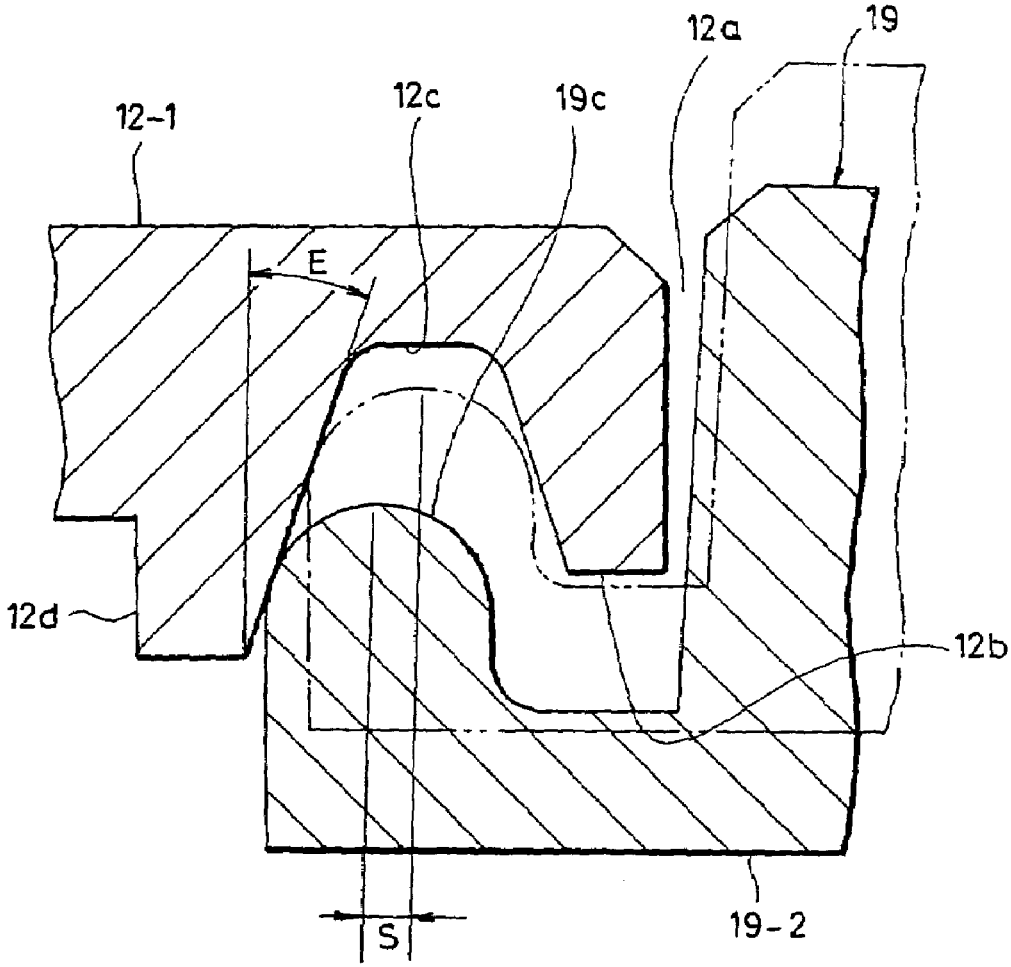
FIG. 17 is an explanatory diagram of an engaged state of a pushing-down operation according to an embodiment of the present invention.

FIG. 4 is a perspective view showing an example of the outside appearance of a mobile phone unit in which a switching device of this embodiment is provided on the lower side of a display screen. FIG. 5 is a perspective view in which the relevant part of the switching device of this embodiment is enlarged and partly shown in section. FIG. 6 is an exploded perspective view for explaining the structure of the switching device of this embodiment. FIG. 7 is a sectional view corresponding to the I—I line in FIG. 5. FIG. 8 is a perspective view of a direction-inputting button of a switching device of this embodiment shown from the back surface. FIG. 9 is a perspective view of a center button assembled into the switching device of this embodiment shown from above, and FIG. 10 is a perspective view of the center button inverted and shown from the bottom surface thereof. FIG. 11 is a perspective view showing a hole portion in the back surface of a case, through which a direction-inputting button of the switching device of this embodiment is installed. FIG. 12 is a perspective view of a resilient sheet of a switching device of this embodiment. FIG. 13 is a perspective view showing a wiring substrate which has contacts of the switching device of this embodiment. FIG. 14 is a schematic sectional view for explaining the structure of a contact of the switching device of this embodiment. FIG. 15 is an exploded perspective view for explaining the assembly order of the switching device of this embodiment. FIGS. 16A and 16B are provided to explain the operation of the switching device of this embodiment, in which FIG. 16A is a schematic sectional view showing a state before pushing down and FIG. 16B is a schematic sectional view showing a state after pushing down. FIG. 17 is an explanatory diagram showing an engaged state of the switching device when pushed down.

In FIG. 4, a reference numeral 10 shows the whole of a mobile phone unit. The mobile phone unit 10 includes a dial button portion case 11 and a display portion case 12; and the dial button portion case 11 has a dial button 13 formed of a plurality of buttons for inputting telephone numbers, characters, symbols, and the like, a microphone 14, an antenna portion 15, an incoming lamp 16, and further, a battery, a memory card, and the like not shown in the figure. On the other hand, the display portion case 12 is provided with a display 17 made of a liquid-crystal display panel and the like, a receiver 18, a direction-inputting button 19 for moving a cursor and the like shown on the display 17, a center button 26 to determine an item selected by a cursor, four specific input keys 20 and so forth, and these are stored in an external casing formed of a front panel 12-1 and a back panel 12-3.

Hereinafter, an example is explained in which a switching device of this embodiment is applied to the direction-inputting button 19 shown in FIG. 4.

First, the structure of the switching device of this embodiment is schematically explained, referring to FIGS. 5 and 6. FIG. 5 diagonally shows in an enlarged manner the direction-inputting button 19 arranged below the display 17 of the display portion case (hereinafter simply called "case") 12 shown in FIG. 4 and the surrounding area. As shown in FIG. 5, the direction-inputting button 19 is formed into an annular shape, because the button-shaped center button 26 is placed at the center thereof, and the upper surface 19-1 is made to be exposed from a circular hole 12*a* provided in the front panel 12-1 (refer to FIG. 4) of the case 12.

Further, as shown in FIG. 6, the direction-inputting button 19 and the center button 26 are installed in a resilient sheet 23 provided on a wiring substrate 24 to cover an area where five contacts 24*a* exist, and are fitted into the case 12 in this state. The area where the five contacts 24*a* on the wiring substrate 24 exist is constructed as switch components, each of which is turned on by being pressed from above. It should be noted that in this installed state, a pusher 23*a*-4 of the resilient sheet 23 is positioned immediately under a direction mark 21-4 of the direction-inputting button 19, as shown on the right-hand side in FIG. 7.

The direction-inputting button 19 shown in FIG. 6 is formed by molding plastic; and as shown in FIG. 5, is a disk having a circular hole 19*a* in the center thereof, and the circular hole 19*a* is chamfered a great deal on the upper surface 19-1 side. Further, as shown in FIG. 8 that is a view shown from the bottom surface 19-2 side, a narrow flange portion 19*b* is provided on the bottom surface 19-2 side of the side surface 19-3 of the disk, four protuberances are provided on the outside of this flange 19*b* with a pitch of approximately 90° with respect to the center of the circular hole 19*a*, and four columnar projections 19*c*-1 to 19*c*-4 whose ends are approximately spherical are provided on the upper surfaces of these protuberances.

Further, as shown in FIG. 8 that shows FIG. 5 in an inverted manner, hole-making processing of counterboring is performed on the circular hole 19*a* in the center of the direction-inputting button 19 from the bottom surface 19-2 side concentrically with and larger than the circular hole 19*a*, and a level difference portion 19-4 is provided on the upper surface 19-1 side of the circular hole 19*a*.

Further, four grooves are formed between the inner circumferential surface 19-7 of the circular hole 19*a* and the side surface 19-3 of the disk, with four ribs 19*d*-1 to 19*d*-4 which function as switch operators being left. As shown in FIG. 8, these ribs 19*d*-1 to 19*d*-4 are provided, being shifted by approximately 45° away from the directions of the four columnar projections 19*c*-1 to 19*c*-4 provided on the flange portion 19*b* of the disk, with respect to the center of the circular hole 19*a*.

Further, as shown in FIGS. 5 to 7, rod-like direction marks 21-1 to 21-4 which explicitly show the rough positions where the direction-inputting button 19 is pushed down are buried in the upper surface 19-1 of the direction-inputting button 19, corresponding to the positions of the four ribs 19*d*-1 to 19*d*-4.

In addition, as shown in FIG. 9 that is a view diagonally shown from above and in FIG. 10 that is a view shown in an inverted manner, the center button 26 shown in FIG. 6 is a button-like part molded from plastic and is a disk in the shape of a rough trapezoid in section with respect to the central axis shown in FIG. 9, and a flange portion 26*a* is provided on the lower part of the side surface 26-3 on the bottom surface 26-2 (refer to FIG. 10) side. Further, a groove 26*b* whose section is approximately rectangular is provided on the bottom surface 26-2 side shown in FIG. 10, and is formed into an annular shape. On this occasion, the diameter of the side surface 26-3 of the center button 26 is made smaller than that of the inner circumferential surface 19-6 of the direction-inputting button 19 shown in FIG. 8, and the diameter of the side surface 26-4 of the flange portion 26*a* of the center button 26 is made smaller than that of the inner circumferential surface 19-7 of the direction-inputting button 19 shown in FIG. 8.

As shown in FIG. 11 that is a view shown from the back surface 12-2 side, the front panel 12-1 of the case 12 shown in FIG. 6 which exposes the direction-inputting button 19 is provided with the circular hole 12*a* which is larger than the outer circumferential surface 19-3 (refer to FIG. 8) of the direction-inputting button 19 and smaller than the outside diameter of the flange 19*b*. Further, a circular wall portion 12*b* which has a predetermined width and height is provided all around the periphery of the hole 12*a*, and four tapered depressions 12*c*-1 to 12*c*-4 are provided in the vicinity of this wall portion 12*b*.

As shown in FIG. 11, these tapered depressions 12*c*-1 to 12*c*-4 are integrally formed in the back surface 12-2 of the front panel 12-1, on the outside the wall portion 12*b* with a pitch of approximately 90° with respect to the center of the hole 12*a*, that is, after arranged approximately in contact with the periphery of the wall portion 12*b*, four columns are joined to the wall portion 12*b* with smooth surfaces, and the tapered depressions 12*c*-1 to 12*c*-4 are formed by performing hole-making processing from above on these four columns in a conical form having an inclination (taper) angle on the inner circumferential surface.

On this occasion, as shown in the section on the left side of the central axis shown in FIG. 7, the tapered depressions 12*c*-1 to 12*c*-4 are positioned such that the distance between the central axis of the hole 12*a* in the front panel 12-1 of the case 12 and the central axes of the holes of the four depressions 12*c*-1 to 12*c*-4 and the distance between the central axis of the direction-inputting button 19 and the central axes of the four hemispherical projections 19*c*-1 to 19*c*-4 are approximately the same.

AS shown in FIG. 11, the sides of the tapered depressions 12*c*-1 to 12*c*-4, that are close to the columnar hole 12*a* are trimmed to have approximately the same height as the upper surface 12-4 of the wall portion 12*b*, and walls 12*d*-1 to 12*d*-4 are left on the sides that are a long distance away from the hole 12*a* of the column. Thus, the surface on the wall portion 12*b* of the back surface 12-2 of the front panel 12-1 and the surface 19-5 of the flange portion 19*b* of the above-mentioned direction-inputting button 19 can be disposed close to each other, and the projections 19*c*-1 to 19*c*-4 of the direction-inputting button 19 are controlled by the walls 12*d*-1 to 12*d*-4 on the upper part of the tapered depressions 12*c*-1 to 12*c*-4 not to come off to a great extent.

As shown in FIG. 12 that is a view shown in an inverted manner, the resilient sheet 23 shown in FIG. 6 is an insulating resilient thin sheet which is approximately circular, into which silicon rubber or the like is molded, the periphery thereof is folded back toward the back surface 23-2 side to be shaped like a skirt, pushers 23*a*-1 to 23*a*-4 and 23*b* are provided, and a cylinder 23*c* is integrally provided on the front surface 23-1 side.

As shown in FIG. 12, the pusher 23*b* is provided at the approximate center of the resilient sheet 23 through a circular pedestal, and the four pushers 23*a*-1 to 23*a*-4 provided around this pusher 23*b* are arranged at the positions corresponding to the approximate centers of the four ribs 19*d*-1 to 19*d*-4 of the direction-inputting button 19 shown in FIG. 8 so as to be pressed, with a pitch of approximately 90° with respect to the center of the pusher 23*b* (refer to the section shown on the right side of the central axis in FIG. 7).

Further, regarding the cylinder 23*c* arranged on the front surface 23-1 side of the resilient sheet 23, the center thereof is made approximately the same as the center of the pusher 23*b*, and the inside and outside diameters and length thereof are determined such that the cylinder 23*c* be installed in the rectangular groove 26*b* in section of the center button 26 shown in FIG. 10 without rattling.

The height of the five pushers 23*a*-1 to 23*a*-4 and 23*b* above the back surface 23-2 is determined not to cause a vertical rattle (allowance) and not to operate the contact on the wiring substrate 24 when the resilient sheet 23 is fitted into the front panel 12-1 of the case 12 along with the wiring substrate 24 described later on, the direction-inputting button 19 and the center button 26, to be the state shown in FIG. 7.

The wiring substrate 24 shown in FIG. 6 is a multilayer wiring substrate or another printed circuit substrate that is pliable (flexible) such as a flexible wiring substrate as in FIG. 13 in which the part corresponding to the direction-inputting button 19 is shown; five contacts 24*a*-1 to 24*a*-4 and 24*b* are provided on the upper surface 24-1 of the wiring substrate 24 in the area where the direction-inputting button 19 is provided, and the positions thereof are made to correspond to the pushers 23*a*-1 to 23*a*-4 and 23*b* on the back surface 23-2 of the resilient sheet 23.

As shown in FIG. 14, each of the contacts 24*a*-1 to 24*a*-4 and 24*b* is one in which a dome component 25 formed of a metal thin plate is provided on the wiring substrate 24; an annular conductive pad 24*c* is formed on the upper surface 24-1 of the wiring substrate 24 with a circular pad 24*d* formed in the center of the conductive pad 24*c*, and the circular periphery of the dome component 25 is arranged to be virtually in contact with the annular conductive pad 24*c* on the whole periphery. Further virtually the whole of the upper surface 24-1 of the substrate 24 is covered with an insulating film not shown in the figure so as to fix the dome component 25.

Further, by pushing down the top of the dome component 25 to be deformed, and by pressing the inside surface of the top against the circular pad 24*d* of the wiring substrate 24, the annular conductive pad 24*c* and the circular pad 24*d* are electrically connected to close the contact, and a sensation of clicking at the time of deforming the shape of the dome component 25 is felt by a finger used for the operation. It should be noted that only an example of a structure of switch components including the contacts 24*a*-1 to 24*a*-4, the dome component 25, and the like arranged on the wiring substrate 24 is shown, and switch components having other structures may be used instead.

As shown in FIG. 15, the switch thus constructed is installed with first the back surface 12-2 side of the front panel 12-1 of the case 12 placed facing upward; then the four approximately spherical projections 19*c*-1 to 19*c*-4 are installed in the tapered depressions 12*c*-1 to 12*c*-4 provided in the vicinity of the hole 12*a* in the front panel 12-1, and the direction-inputting button 19 is installed.

Further, after installing the flange portion 26*a* of the center button 26 in the level difference portion 19-4 of the circular hole 19*a* in the center of the direction-inputting button 19, the cylinder 23*c* of the front surface 23-1 of the resilient sheet 23 is fitted into the groove 26*c* of the center button 26.

Further the installation is completed by putting from above the wiring substrate 24 which is positioned by means not shown in the figure not to be misaligned with the back panel 12-3 (refer to FIG. 5) of the display portion case 12; after that, the whole construction is inverted to obtain the installed state shown in FIGS. 5 and 7.

As regards the operation of the switching device thus constructed; before the direction-inputting button 19 shown in FIG. 16A is pushed down, the direction-inputting button 19 is pushed up by means of the biasing force of the dome components 25-1 to 25-5 (refer to FIG. 13) on the wiring substrate 24 and resilience by the resilient sheet 23 and the pushers 23*a*-1 to 23*a*-4 and 23*b*, and the projections 19*c*-1 to 19*c*-4 of the direction-inputting button 19 are fallen into the tapered depressions 12*c*-1 to 12*c*-4 in the back surface 12-2 of the front panel 12-1 of the case 12 and the position thereof is thus determined. Note that FIGS. 16A and 16B show the I—I section in FIG. 5.

Next, when the upper part of the direction mark 21-4, shown in FIG. 16A, of the direction-inputting button 19 is pushed down in the direction of the arrow (refer to FIG. 5), as shown in FIG. 16B, regarding the direction-inputting button 19 in comparison with the state in FIG. 16A, the upper surface 19-1 leans toward the pushed-down side by a predetermined angle θ, and the direction-inputting button 19 descends by δ in height as a whole. Thus, with the resilient sheet 23, placed below the rib 19*d*-4, being deformed in shape, by pushing down the pusher 23*a*-4 thereof, pressing the dome component 25-4 with the pusher 23*a*-4 to deform the shape, pressing the inside surface of the dome component 25-4 against a circular pad 24*d*-4 on the side of the wiring substrate 24, and electrically connecting the circular pad 24*d*-4 with an annular conductive pad 24*c*-4, the contact is closed and a sensation of clicking to a finger is obtained.

On this occasion, as shown in FIG. 16B, due to the pushing-down operation, there is a space created between the tapered depressions 12*c*-1 to 12*c*-4 in the vicinity of the hole 12*a* in the front panel 12-1 of the case 12 of the display portion and the projections 19*c*-1 to 19*c*-4 of the direction-inputting button 19, which were engaged with each other and were thus positioned before the pushing-down operation. Specifically, as shown in FIG. 17 that is an enlarged view of the D portion shown in FIG. 16B, the direction-inputting button 19 shifts not only vertically but also horizontally (the distance S shown in FIG. 17) because of the pushing-down operation, from the state (state of FIG. 16A) before the pushing-down operation shown by the chain double-dashed line, and there is a possibility that the projection 19*c* will come off the tapered depression 19*c* and will not be able to return to the original position thereof; in this embodiment, however, since the tapered depressions 12*c*-1 to 12*c*-4 are processed to have the high walls 12*d*-1 to 12*d*-4 on the outer peripheries thereof, the projections 19*c*-1 to 19*c*-4 will not come off the depressions 12*c*-1 to 12*c*-4.

Next, when the operational force is released, the state shown in FIG. 16B in which the pushing-down operation is taking place returns to the state shown in FIG. 16A because of the restoring force of the dome components 25-1 to 25-4 and the resilient sheet 23. Specifically, as shown in FIG. 17, the approximately spherical end of the projection 19*c* provided in the direction-inputting button 19 is in contact with and follows the taper surface, whose inclination angle is E, of the depression 12*c* in the back surface 12-2 of the front panel 12-1 of the case 12, and the direction-inputting button 19 is centered in its original position shown by FIG. 16A or shown by the chain double-dashed line in FIG. 17 that is a predetermined state before the pushing-down operation.

In addition, the inclination angle E of the inner walls of the depressions 12*c*-1 to 12*c*-4 is made 10 to 20° with respect to the central axes of the holes of the depressions 12*c*-1 to 12*c*-4, for example.

This kind of operation can also be performed by pushing down other direction marks 21-1 to 21-3 of the direction-inputting button 19 shown in FIGS. 4 and 5; the contact 24*a*-1 can be operated by leaning the direction-inputting button 19 in a downward direction in FIG. 4 (pushing down the direction mark 21-1); the contact 24*a*-3 can be operated by leaning it in an upward direction in FIG. 4 (pushing down the direction mark 21-3); and the contact 24*a*-2 can be operated by leaning it in a leftward direction in FIG. 4 (pushing down the direction mark 21-2).

In addition, if, for example, the direction mark 21-4 of the upper surface 19-1 corresponding to the rib 19-4 of the direction-inputting button 19 is pushed down (refer to FIG. 16A), the direction-inputting button 19 descends by δ in height as a whole and inclines its upper surface 19-1 toward the pushed-down side by an angle θ as described above; as a result, not only the pusher 23*a*-4 placed immediately below the rib 19-4 but also the pusher 23*a*-1, 23*a*-3 or 23*a*-2 descends. However, the amount by which these pushers 23*a*-1 to 23*a*-3 descend is not sufficient to deform the corresponding dome components 25-1 to 25-3 in shape and to close the contacts, so that the contacts 24*a*-1 to 24*a*-3 are not operated.

Further, as shown in FIGS. 5 and 16A, although the center button 26 is placed on the resilient sheet 23 together with the direction-inputting button 19, effects on the center button 26 caused by the direction-inputting button 19 being pushed down are separated by means of the pliability of the resilient sheet 23, so that no force is exerted on the contact 24*b* in the center, and similarly since effects on the direction-inputting button 19 caused by the center button 26 being pushed down are also separated, the direction-inputting button 19 and the center button 26 can execute respective operations individually.

Further, an operation in which an item [selected] on a menu by moving a cursor with the direction-inputting button 19 is [determined] with the center button 26 is possible, for example. Further, the switching device of this embodiment can also be used as a five-contact input switching device formed of four contacts by the direction-inputting button 19 and one contact by the center button 26.

According to the switching device of this embodiment, when the upper part of one of the direction marks 21-1 to 21-4 on the upper surface 19-1 of the direction-inputting button 19 that is an example of a button is pushed down, one of the pushers 23*a*-1 to 23*a*-4 on the back surface 23-2 of the resilient sheet 23 is selectively pushed by means of the four ribs 19*d*-1 to 19*d*-4 provided on the back surface 19-2, so that it is possible for one annular direction-inputting button 19 to operate one intended contact out of four contacts on the substrate.

Further, although the direction-inputting button 19 is not fixed to the resilient sheet 23, the position to which the direction-inputting button 19 returns does not shift with respect to the hole 12*a* in the front panel 12-1, even if the direction-inputting button 19 is repeatedly pushed down and released. Specifically, with the release of the pushing-down force, the projections 19*c*-1 to 19*c*-4, whose ends are approximately spherical, of the direction-inputting button 19 move along the tapered surfaces of the inner walls of the tapered depressions 12*c*-1 to 12*c*-4 in the front panel 12-1 of the case 12 and the direction-inputting button 19 can returned to its original position where centered, so that the hole 12*a* of the case 12 and the outer circumferential surface 19-3 of the direction-inputting button 19 can always return to the state in which there is an intended space between them.

Further although the direction-inputting button 19 that is an example of a button is not fixed to the resilient sheet 23 in a predetermined position, since there is always an intended space formed between the hole 12*a* of the case 12 and the direction-inputting button 19 with the release after the pushing-down operation, a switch with a favorable function can be obtained, when the direction-inputting button 19 and the resilient sheet 23 are installed into the case 12 without being stuck and fitted into each other.

For this reason, it is not necessary to stick the direction-inputting button 19 and the resilient sheet 23 together, so that the assembly operation cost can be reduced.

It should be noted that although in this embodiment an example is explained in which the projections 19*c* whose ends are virtually spherical are provided on the side of the direction-inputting button 19 functioning as an operational button of the switching device while the tapered depressions 12*c* are provided in the vicinity of the hole 12*a* in the back surface 12-2 of the front panel 12-1 of the case 12; however not limited thereto, projections may be provided on the case 12 side while tapered depressions may be provided on the button side, and further, needless to say, projections and depressions may be alternately provided both on the direction-inputting button 19 side and in the vicinity of the hole 12*a* in the case 12, for example.

Further, although an example in which the annular four-direction inputting button 19 serves as an operational button of the switching device has been explained, needless to say, the present invention may be applied to a one-input push-button used for inputting characters such as the kana and alphabet and numerals.

Further, an example in which four projections 19*c* are arranged with a pitch of approximately 90° with respect to the center of the direction-inputting button 19 while four tapered depressions 12*c* are arranged with a pitch of approximately 90° with respect to the center of the hole 12*a* in the front panel 12-1 has been explained; however, as opposed to the foregoing example; not limited thereto, since engaging positions formed by depressions and projections are provided to return a button which has been pushed down to a predetermined position, when the two of these engagement positions are provided, horizontal shift is improved, and when three thereof are provided, the slanting of the upper surface of the button at the time of its return is improved, which means that the number of engagement positions formed by depressions and projections may be decided according to the form of a button needed, such as shape, size and pushed-down strokes.

Further, an example in which the resilient sheet 23 provided with the pushers 23*a*-1 to 23*a*-4 is placed between the direction-inputting button 19 and the wiring substrate 24 provided with the contacts 24*a*-1 to 24*a*-4 has been explained; however, if a direction-inputting button is allowed to slightly rattle in a case, protrusions for pressing contacts may be provided on the contact side of the direction-inputting button to operate the contacts on a wiring substrate by directly pushing them down without using a resilient sheet with pushers, for example. On this occasion, if a flexible member such as a flexible wiring board is used for the wiring substrate and a flat insulating resilient sheet is placed thereunder, it is possible to construct a switching device having no rattle in a simple and convenient manner, without specific molding processing to the resilient sheet.

Further, although the above-mentioned embodiment is an example in which the present invention has been applied to an input button of a mobile phone unit, it can also be applied to other electronic equipment such as portable electronic equipment or to an operational button of a remote control device of electronic equipment, and the like.

It should be understood by those skilled in the art that various modifications, combinations, sub-combinations and alterations may occur depending on design requirements and other factors insofar as they are within the scope of the appended claims or the equivalents thereof.

What is claimed is:

1. A switching device comprising:

a button which operates a switch component in accordance with a pushing-down operation;

a case which stores said button in a state in which at least a pushed-down surface is exposed;

a first position-deciding portion provided on the periphery of said button; and a second position-deciding portion provided on the surface of said case in contact with said button at a position corresponding to said first position-deciding portion;

wherein the position of said button is fixed to said case by said first and second position-deciding portions engaging with each other, wherein said first position-deciding portion is a projection or depression provided on the periphery of said button, and said second position-deciding portion is a depression or projection provided at a position corresponding to the projection or depression of said button respectively.

2. The switching device according to claim 1, wherein the depression in said first position-deciding portion or said second position-deciding portion is a tapered depression.

3. The switching device according to claim 2, wherein the projection in said first position-deciding portion or said second position-deciding portion is a columnar projection whose end is approximately spherical.

4. The switching device according to claim 1, wherein the projection in said first position-deciding portion or said second position-deciding portion is a columnar projection whose end is approximately spherical.

5. The switching device according to claim 1, further comprising:

a substrate on which said switch component is arranged;

wherein said button is disk-shaped, said first position-deciding portion of said button is provided at four positions with a pitch of approximately 90° with respect to the center of said button, and said second position-deciding portion of said case is also provided at four positions with a pitch of approximately 90°; and said switch component is provided at four positions on said substrate, being shifted approximately 45° away from each projection or depression of said button.

6. The switching device according to claim 1, further comprising:

a substrate on which said switch component is arranged;

a resilient sheet arranged on said substrate; and said button arranged on said resilient sheet;

wherein on the periphery of said button are provided a plurality of projections or tapered depressions in the direction approximately at right angles to said pushed-down surface, and on the surface of said case in contact with said button are provided a plurality of tapered depressions or projections which engage with projections or tapered depressions of said button respectively.

7. The switching device according to claim 6, wherein said projections are column-shaped whose ends are approximately spherical.

8. The switching device according to claim 7, wherein said button is disk-shaped, the projections or depressions of said button are provided at four positions with a pitch of approximately 90° with respect to the center of said button, and the depressions or projections of said case are also provided at four positions with a pitch of approximately 90°; and said switch component is provided at four positions on said substrate, being shifted approximately 45° away from each projection or depression of said button.

9. The switching device according to claim 6, wherein said button is disk-shaped, the projections or depressions of said button are provided at four positions with a pitch of approximately 90° with respect to the center of said button, and the depressions or projections of said case are also provided at four positions with a pitch of approximately 90°; and said switch component is provided at four positions on said substrate, being shifted approximately 45° away from each projection or depression of said button.

10. A portable terminal device which operates a switch component in accordance with a button being pushed down, comprising:

a case which stores said button in a state in which at least a pushed-down surface is exposed;

a first position-deciding portion provided on the periphery of said button; and a second position-deciding portion provided on the surface of said case in contact with said button at a position corresponding to said first position-deciding portion;

wherein the position of said button is fixed to said case by said first and second position-deciding portions engaging with each other, wherein said first position-deciding portion is a projection or depression provided on the periphery of said button, and said second position-deciding portion is a depression or projection provided at a position corresponding to the projection or depression of said button respectively.

11. The portable terminal device according to claim 10, wherein the depression in said first position-deciding portion or said second position-deciding portion is a tapered depression.

12. The portable terminal device according to claim 11, wherein the projection in said first position-deciding portion or said second position-deciding portion is a columnar projection whose end is approximately spherical.

13. The portable terminal device according to claim 10, wherein the projection in said first position-deciding portion or said second position-deciding portion is a columnar projection whose end is approximately spherical.

14. The portable terminal device according to claim 10, further comprising:

a substrate on which said switch component is arranged;

wherein said button is disk-shaped, said first position-deciding portion of said button is provided at four positions with a pitch of approximately 90° with respect to the center of said button, and said second position-deciding portion of said case is also provided at four positions with a pitch of approximately 90°; and said switch component is provided at four positions on said substrate, being shifted approximately 45° away from each projection or depression of said button.

15. The portable terminal device according to claim 10, further comprising:

a substrate on which said switch component is arranged;

a resilient sheet arranged on said substrate; and said button arranged on said resilient sheet;

wherein on the periphery of said button are provided a plurality of projections or tapered depressions in the direction approximately at right angles to said pushed-down surface, and on the surface of said case in contact with said button are provided a plurality of tapered depressions or projections which engage with projections or tapered depressions of said button respectively.

16. The portable terminal device according to claim 15, wherein said projections are column-shaped whose ends are approximately spherical.

17. The portable terminal device according to claim 16 wherein said button is disk-shaped, the projections or depressions of said button are provided at four positions with a pitch of approximately 90° with respect to the center of said button, and the depressions or projections of said case are also provided at four positions with a pitch of approximately 90°; and said switch component is provided at four positions on said substrate, being shifted approximately 45° away from each projection or depression of said button.

18. The portable terminal device according to claim 15, wherein said button is disk-shaped, the projections or depressions of said button are provided at four positions with a pitch of approximately 90° with respect to the center of said button, and the depressions or projections of said case are also provided at four positions with a pitch of approximately 90°; and said switch component is provided at four positions on said substrate, being shifted approximately 45° away from each projection or depression of said button.

* * * * *